United States Patent [19]

Hix, Jr.

[11] Patent Number: 4,676,534

[45] Date of Patent: Jun. 30, 1987

[54] LOCK ASSEMBLY

[75] Inventor: Willis G. Hix, Jr., Hacienda Heights, Calif.

[73] Assignee: Perfection Machine & Tool Works, Los Angeles, Calif.

[21] Appl. No.: 885,892

[22] Filed: Jul. 16, 1986

[51] Int. Cl.[4] ..... E05C 1/04

[52] U.S. Cl. ..... 292/205

[58] Field of Search ..... 292/205, 104, 148, 31, 292/350, DIG. 31, DIG. 68

[56] References Cited

U.S. PATENT DOCUMENTS

| | | | |
|---|---|---|---|
| 525,256 | 8/1894 | Buckley . | |
| 773,648 | 1/1904 | Kilian | 292/148 |
| 968,024 | 8/1910 | Beehler . | |
| 1,191,600 | 7/1916 | Joneson . | |
| 1,326,554 | 12/1919 | Watson | 292/236 |
| 1,894,913 | 6/1932 | Sadler . | |
| 3,515,423 | 6/1970 | De Smidt | 292/256.71 |
| 3,843,173 | 10/1974 | Harrell | 292/DIG. 68 X |

FOREIGN PATENT DOCUMENTS 191063 10/1907 Fed. Rep. of Germany .

*Primary Examiner*—Richard E. Moore

*Attorney, Agent, or Firm*—Nilsson, Robbins, Dalgarn, Berliner, Carson & Wurst

[57] ABSTRACT

A lock assembly includes a first member rotatably mounted to a housing plate. The first member has a first aperture with flared sidewalls and a second aperture with flared sidewalls. A second member is fixed to the housing adjacent to the first member. The second member is positioned adjacent to the first aperture but not the second aperture. The first member extends through the housing plate and is fixed to a latch mechanism. When a padlock is inserted through the first aperture and is locked, the first member is prevented from rotation by the second member. However, when the padlock is inserted through the second aperture, the padlock does not strike the second member allowing the member to rotate freely. The padlock also functions as a handle when in the second aperture, eliminating the need for a separate handle.

6 Claims, 3 Drawing Figures

LOCK ASSEMBLY

BACKGROUND OF THE INVENTION

The present invention relates generally to lock assemblies and, more particularly, to an assembly having a cylindrical member which has two apertures arranged such that a padlock, when inserted through one aperture, prevents opening of the lock but when inserted through the other aperture, can function as a handle to facilitate opening of the lock.

Lock assemblies of various configurations are known. For example, Buckley, U.S. Pat. No. 525,256, describes a lock assembly which has a shaft having an arm disposed in a door and rotated manually by a head portion. When the door is closed the head portion is rotated such that the arm extends through an opening in the door and abuts the door frame thereby preventing the door from sliding open. A post having an aperture is attached to the door and positioned over the head portion which also includes an aperture. When the head portion is rotated to allow the arm to abut the door frame, the apertures are aligned. A padlock can then be inserted through the apertures thereby preventing the head portion from rotating.

U.S. Pat. No. 773,648 to Kilian describes a box fastener whereby the cover includes a plate which is urged outwardly by a spring against the sides of the box which have grooves. A bolt is attached to the plate and extends through a slot disposed through the cover. The plate is slidably mounted in a track plate which includes a guide pin also extending through the slot. When the cover is placed on the box the spring urges the plate into the groove formed in sides of the box thereby securely fastening the cover to the box. The bolt includes a tongue portion which engages the guide pin when the plate engages the groove. A wire can then be slipped through a hole in the tongue and clenched in a seal.

German Pat. No. 191,063 to Otto Martin and Co. describes a knob having a cylindrical extension disposed in a hollow cylindrical member which includes a latching arm. The knob extension and the hollow cylindrical member both have an aperture which are aligned to each other to enable the knob to rotate the latching arm.

U.S. Pat. No. 968,024 to Beehler describes a lock assembly for boxes where the inner front wall of the box has a secured plate. The central part of the plate provides a channel with a cylindrical locking rod placed in the channel. The lower end and the upper end of the locking rod are bent perpendicular to the body of the locking rod. The lower end projects through a U-shaped slot formed through the lower portion of the plate while the upper end is flattened and includes a formed aperture. Since the lower end of the locking rod projects through the U-shaped slot, the locking rod cannot be removed from the channel. The cover of the box includes a plate having a slot placed over an opening formed in the cover. The plate is fixed to the cover and further includes two ear members projecting upward from the plate whereby each ear has an aperture. When the cover is placed over the box, the upper end of the locking rod will automatically be in a central position because gravity will urge the lower end of the locking rod to the central part of the U-shaped slot. This allows the locking rod to project through the cover plate slot. The flat upper end of the locking rod can then be rotated to abut either of the two ear members. A wire or thin metal seal can then be passed through the apertures in the upper end and the ear member. When the upper end is rotated in such a manner it no longer is aligned to pass through the cover plate slot thereby preventing the cover from being lifted off.

U.S. Pat. No. 1,191,600 to Joneson describes a door latch for sliding doors. The sliding door includes a spring latched handle which rotates a catch, on each side of the sliding door. The sliding door further includes a recess for each of the catches so that when the catches are in the recesses, the catches do not protrude from the inner side of the sliding door thereby allowing the sliding door to open. When the sliding door is closed, the handle is pushed against the force of the spring and rotated so that each catch engages a recess formed in the door frame. The door frame includes a staple having an aperture while the handle also has an aperture. When the sliding door is closed and the handles are located such that the catches engage the door frame recesses, a padlock can be placed through the staple aperture and through the adjacent handle aperture thereby preventing the handle from further rotation.

U.S. Pat. No. 1,894,913 to Sadler describes a door latch for sliding doors whereby an inner and outer handle are mounted to a lift-latch which includes a tongue portion. When the door is in the closed position, the tongue portion extends through an opening formed through the door frame and abuts a keeper plate mounted to the door frame. The door is opened by rotating either handle to lift the lift-latch against the force of a spring thereby allowing the tongue portion to pass clearly through the door frame opening. The door frame further includes a plate which has an aperture formed therein while the outer handle also has an aperture formed therein. When the apertures of the outer handle and door frame plate align, a padlock can be passed through them thereby preventing the rotation of the outer handle.

U.S. Pat. No. 3,515,423 to Smidt describes a lock assembly for enclosures. Smidt describes three embodiments which utilize a padlock for securing a cover to the enclosure body and further preventing the unauthorized removal of the cover. In the first embodiment, the cover includes an elevated center portion to increase the interior space of the enclosure, and an outer flange portion. One corner of the cover flange portion has a locking post extending downward through the flange and into the enclosure body. The locking post also includes an exposed head which has an aperture adapted to receive the shank of a padlock. The exposed head also has a slot which is adapted to receive a tool or instrument such as a screwdriver for turning the post. When the locking post is threaded into the enclosure body and the shank of the padlock is inserted through the aperture, the presence of the cover's elevated center portion precludes the turning of the padlock thereby prohibiting removal of the post from the enclosure body since the post is threaded into the body. Unlike the cover of the first embodiment, a second embodiment includes a cover which is flat across the entire top surface and does not provide a distinct elevated portion. However, the locking post described in the first embodiment is also utilized in the second embodiment. In order to provide a surface which blocks the rotation of the padlock extending through the aperture in the locking post head, a short ribbed portion is fixed on the cover adjacent to the locking post. A third embodiment also utilizes a locking post as described in the first and second embodiments however, there is provided a hexagonal shaped cutout portion for receiving a tool or instrument such as an Allen wrench. In the third embodiment, the locking post does not extend through the cover as in the first and second embodiments but extends downward into the enclosure body only. Unlike the covers of the two previous embodiments, the cover of the third embodiment has a surface which extends adjacent to the apertured post head to block the rotation of a padlock which is mounted through the post head. Additionally, the post head is not threaded into the enclosure body but operates a latching mechanism.

All of the above locking assemblies do not utilize a rotatable member having two apertures. One aperture for receiving a padlock to prevent the member from rotating to open the latch mechanism, and the other aperture for receiving the padlock to enable the member to rotate and open the latch mechanism with the padlock functioning as a handle.

SUMMARY OF THE INVENTION

The present invention comprises a lock assembly for operating a latch mechanism positioned on one side of a housing plate. The lock assembly includes a first member coupled to the latch mechanism with the first member rotatably mounted to the housing plate. The first member includes an extension portion extending from the other side of the housing plate where the extension portion has a first and a second aperture. The lock assembly further includes a second member fixed to the other side of the housing plate adjacent to the extension portion. The second member protrudes from the other side of the housing plate such that the first member is prevented from rotating to open the latch mechanism when a padlock is positioned in the first aperture but rotates normally when the padlock is positioned in the second aperture. When the padlock is positioned in the second aperture, it can also function as a handle to facilitate turning of the first member to open the latch mechanism.

DETAILED DESCRIPTION

Figure 1:
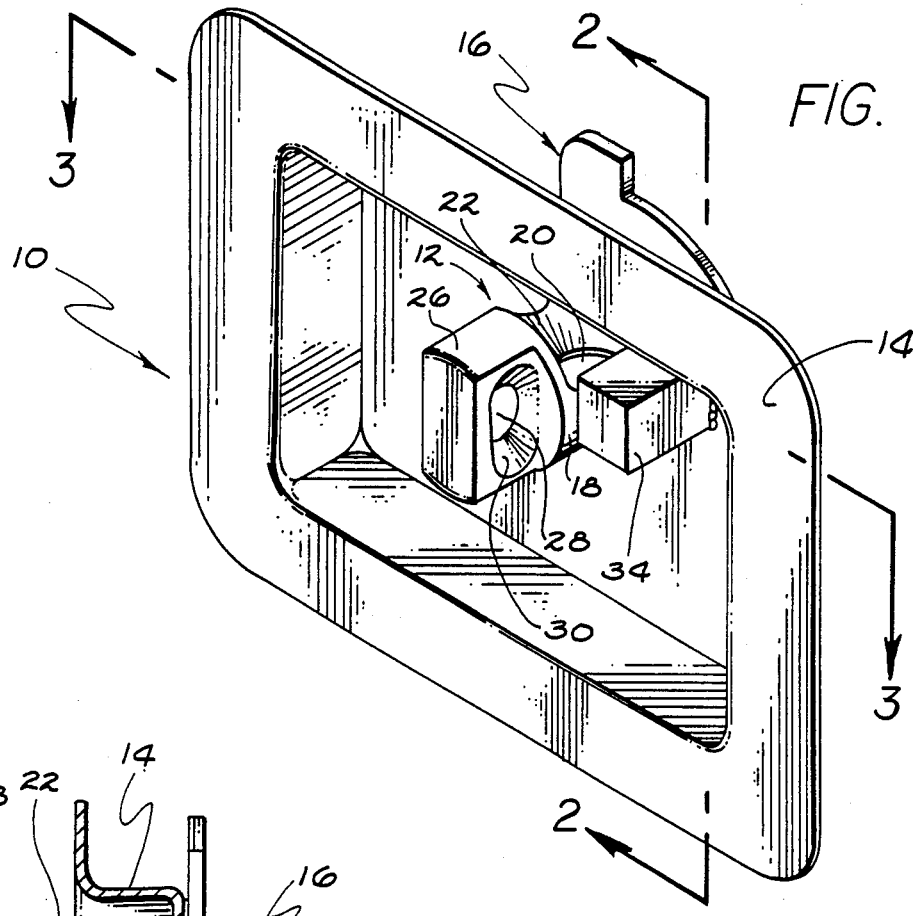
FIG. 1 is a front perspective view of the present invention.
Figure 2:
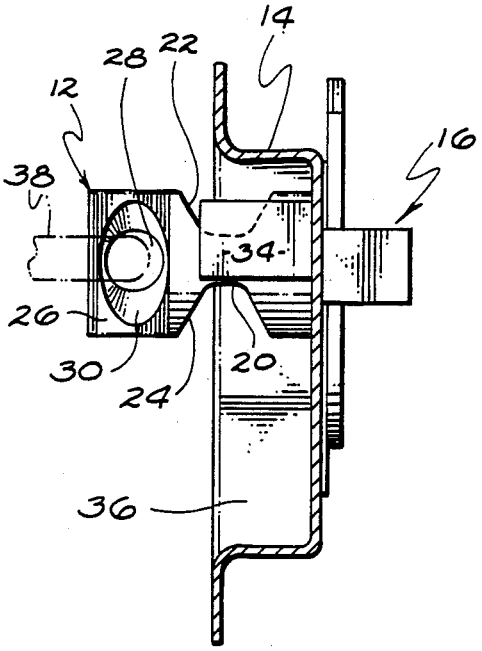
FIG. 2 is a cross-sectional side view of the present invention taken about lines 2—2 in FIG. 1.
Figure 3:
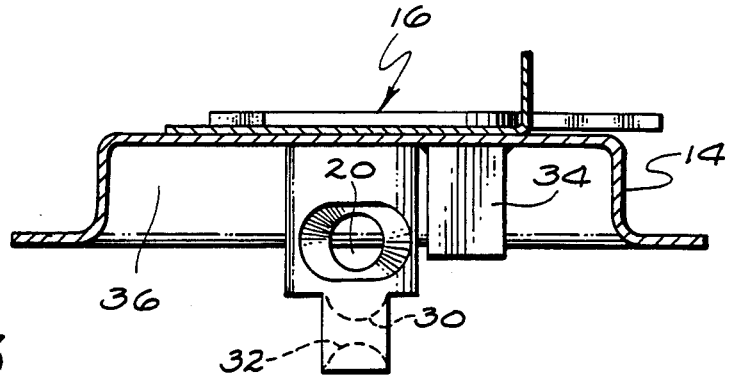
FIG. 3 is a cross-sectional top view of the present invention taken about line 3—3 in FIG. 1.

Referring to FIGS. 1-3, the lock assembly 10 of the invention includes a first member 12, preferably cylindrically shaped, rotatably mounted to and extending through a housing plate 14. A latch mechanism 16 is disposed behind the housing plate 14 and is coupled to the first member 12. The latch mechanism 16 is operated by rotating the first member 12. The particular latch mechanism 16 behind the housing plate may be any suitable or conventional mechanism without departing from the present invention.

The first member 12 includes a first extention portion 18 which includes a first aperture 20 having first outwardly flared sidewalls 22 and second outwardly flared sidewalls 24. The first member 12 further includes a second extension portion 26 which has a second aperture 28 (as shown in FIG. 2) having first outwardly flared sidewalls 30 and second outwardly flared sidewalls 32. In the preferred embodiment, the first aperture 20 and second aperture 28 are transverse to each other, preferably at ninety degrees.

The lock assembly further includes a second member 34 which is preferably block shaped fixed to the housing plate 14 adjacent to the first member 12. The second member 34 protrudes outwardly in the same direction as the first member 12 up to or past the first aperture 20, but not protruding to the second aperture 28. Referring to FIG. 3, the housing plate 14 preferably forms a recess 36 in which the first member 12 and second member 34 are disposed.

Referring to FIG. 2, when the padlock 38 has its shaft disposed in the outer aperture 28 the padlock may function as a handle thereby allowing a user to rotate the first member 12. The second member 34 will not preclude the rotation of the first member 12 because it does not extend outwardly far enough to contact the padlock shaft as it is being rotated.

Therefore, the padlock is used for both securing the lock assembly and as a handle to operate the latch mechanism. Since the padlock can function as a handle, additional tools or instruments such as screwdrivers or wrenches are not necessary and the need for a handle is not needed thereby decreasing the amount of material for constructing the lock assembly. Additionally, since the padlock is always in use and is either in the first aperture 20 or the second aperture 28, the padlock will not be lost due to misplacement.

From the foregoing it has been shown that the present invention provides a lock assembly which utilizes padlock for securing the lock assembly and also functioning as a handle to rotate a member which operates a latch mechanism. Although specific embodiments of the invention have been illustrated and described, various modifications and changes may be made without departing from the spirit and scope of the invention. For example, the apertures do not have to be disposed transverse to each other as long as the second member does not preclude the normal rotation of the first member when the padlock is inserted through the second aperture. Additionally, the housing plate does not have to form a recess for receiving the first member or the second member.

What is claimed is:

1. A lock assembly for operating a latch mechanism, the lock assembly comprising:

a housing plate, the latch mechanism positioned on one side of the housing plate;

a first member coupled to the latch mechanism and extending through the plate for operating the latch mechanism, the first member being rotatable relative to the housing plate, the first member having an extension portion positioned on the other side of the housing plate, the extension portion having a transverse first aperture and a transverse second aperture spaced from first transverse aperture; and a second member fixed to the housing plate extending adjacent to the first aperture but not the second aperture, the first member being prevented from rotating to operate the latch mechanism when a padlock is in the first aperture, and the first member being rotatable to operate the latch mechanism when the padlock is in the second aperture, the padlock functioning as a handle for facilitating rotation of the first member when the padlock is in the second aperture.

2. The lock assembly as defined in claim 1, whereion the first and second apertures are transverse to each other.

3. The lock assembly as defined in claim 2, wherein the first and second apertures are at ninety degrees to each other.

4. The lock assembly as defined in claim 3, wherein the first and second apertures each have flared sidewalls.

5. The lock assembly as defined in claim 4, wherein the extension portion is cylindrically shaped and the second member has a quadrilateral cross-section.

6. The lock assembly as defined in claim 5, wherein the one side of the housing plate forms a recess for receiving the first member and the second member.

* * * * *